US007475638B2

(12) United States Patent
Haeselich

(10) Patent No.: US 7,475,638 B2
(45) Date of Patent: Jan. 13, 2009

(54) PROJECTILE WITH MEANS FOR MARKING ITS STRIKE POINT

(75) Inventor: Detlef Haeselich, Muessen (DE)

(73) Assignee: Nico-Pyrotechnik Hanns-Juergen Diederichs GmbH & Co. KG, Trittau (DE)

( * ) Notice: Subject to any disclaimer, the term of this patent is extended or adjusted under 35 U.S.C. 154(b) by 77 days.

(21) Appl. No.: 11/288,006

(22) Filed: Nov. 28, 2005

(65) Prior Publication Data

US 2007/0119329 A1 May 31, 2007

(30) Foreign Application Priority Data

Nov. 9, 2005 (DE) ..... 10 2005 053 491

(51) Int. Cl.
*F42B 8/16* (2006.01)

(52) U.S. Cl. ..... 102/513; 102/498; 102/499; 102/502; 102/529; 102/444

(58) Field of Classification Search ..... 102/498, 102/499, 502, 513, 529, 444
See application file for complete search history.

(56) References Cited

U.S. PATENT DOCUMENTS 3,292,543 A * 12/1966 Tisch ..... 102/334
6,615,739 B2 * 9/2003 Gibson et al. ..... 102/513
6,619,211 B1 9/2003 Haeselich
6,871,594 B1 * 3/2005 Estrella ..... 102/498

FOREIGN PATENT DOCUMENTS

DE 10 2004 017 464 A1 * 11/2005

* cited by examiner

*Primary Examiner*—Stephen M Johnson
(74) *Attorney, Agent, or Firm*—Milde & Hoffberg, LLP

(57) ABSTRACT

A training projectile includes at its head a hollow arched cavity or cap that defines a hollow cavity within the head of the training projectile, and that bursts when the projectile strikes a target. Into this cavity are placed a first chemically-inactive marking material and a second chemically-active marking material, whereby both marking materials are released upon bursting of the arched cavity. The first marking material creates, for example, a color effect by means of a colored powder; the second marking material produces a light effect by means of, for example, materials that interact to produce chemo-luminescence.

1 Claim, 1 Drawing Sheet

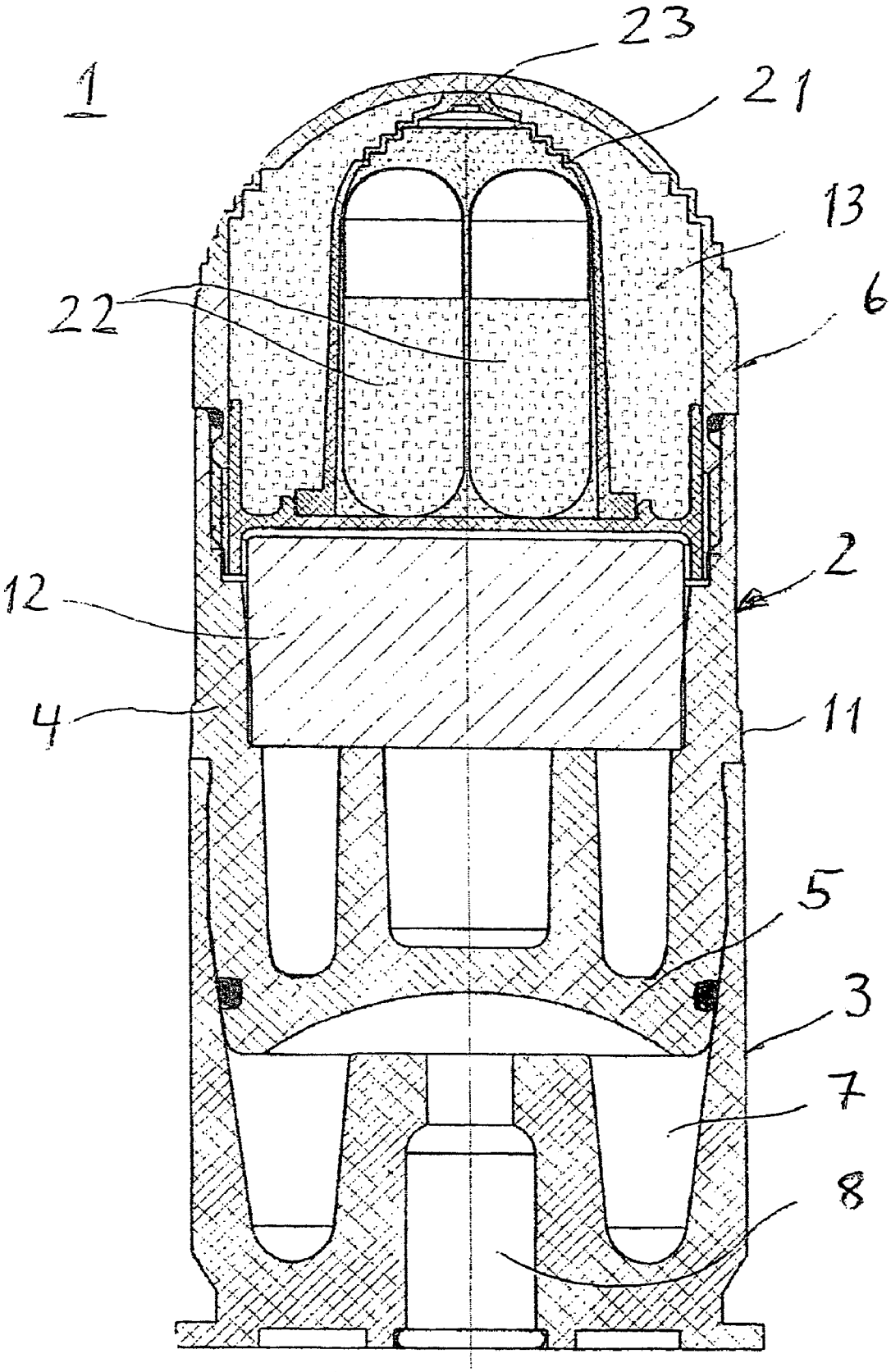
1
23
21
13
22
6
2
12
4
11
5
3
7
8

PROJECTILE WITH MEANS FOR MARKING ITS STRIKE POINT

BACKGROUND OF THE INVENTION

The invention relates to a training projectile whose strike point on a target or target area is optically marked.

It is important in projectiles which themselves possess no live explosive charge to make the strike point visible so that optimum training results, and subsequently optimum live-fire training results, are achieved.

Projectiles of the type discussed here are, for example, medium-caliber projectiles of 40 mm that are used individually or are mounted in a feed belt, and are fired in series from a rapid-fire weapon. Likewise, a dropped bomb, grenade launcher, trench mortar or similar may be simulated.

Projectiles are known that include a hollow arched cavity or cap at their head that bursts upon striking a target, and into which a marking material, for example a reddish dye powder, has been inserted that is released upon bursting of the arched cavity when the projectile strikes the target. The dye material is hereby scattered for a fixed radius about the strike point and is also scattered by wind, and clearly designates the strike point optically.

In this training projectile, the dye powder at the strike point on the target is visible optically only during daylight, and not under darkness. Also, dye powders cannot be clearly distinguished under severe weather conditions.

Along with marking by means of a chemically-inactive dye powder, it is known from U.S. Pat. No. 6,619,211 B1, for example, to use several chemically-interactive components as a marking material that are inserted into the arched cavity in two or more separated containers. When the containers break, the components mix together and create chemo-luminescence in a chemical reaction, i.e., an optical light effect that is also visible in darkness.

Both solutions are unsatisfactory since, depending on the time of day and weather conditions, several types of projectiles must be made available.

SUMMARY OF THE INVENTION

The principal object of the invention is to provide a training projectile that may be universally used. The projectile must clearly mark the target strike point under all weather conditions, both by day and by night.

This object, as well as further objects which will become apparent from the discussion that follows, are achieved, according to the invention, by providing a training projectile which includes a hollow arched cavity or cap at its head that defines a hollow cavity within the head of the training projectile, and that bursts when the projectile strikes a target. Into this cavity are placed a first chemically-inactive marking material and a second chemically-active marking material. When the arched cavity bursts, both marking materials are released, whereby the first marking material provides a color effect and the second marking material provides a light effect.

With such a configuration of a training projectile, the strike point is made clearly visible both by day and by night. The additional light effect reinforces the color effect of the chemically-inactive marking material even under severe weather conditions.

Several options are available to implement both optical effects.

For example, a first marking material may be a dye powder while the second marking material may include a component that creates the light effect by means of chemo-luminescence in a chemical reaction with at least one additional component.

The various components of the second marking material may, for example, be inserted into containers that rest within the hollow cavity of the arched cavity and are embedded within the first marking material, for example the dye powder.

Such a solution has the advantage that there is no high-energy material within the projectile, particularly no explosive material that might be triggered by means of heat from a catastrophic fire, for example, which greatly simplifies storage. Such ammunition is designated as "green ammunition."

It is also possible that the second chemically-active marking material is a pyrotechnic or explosive material that is ignited when the training projectile strikes a target, for example by means of the energy of the impact itself or by means of an impact igniter.

This version with pyrotechnic or explosive material has the advantage that the first chemically-inactive marking material, for example the dye powder, is distributed over a larger spatial area and is thus made more visible by means of the pressure waves of the pyrotechnic material upon impact with the target.

For a full understanding of the present invention, reference should now be made to the following detailed description of the preferred embodiments of the invention as illustrated in the accompanying drawings.

BRIEF DESCRIPTION OF THE DRAWINGS

The single FIG. 1 shows a cross-section through a cartridge round possessing a training projectile.

DESCRIPTION OF THE PREFERRED EMBODIMENT

FIG. 1 shows training ammunition 1 in cross-section view that includes a training projectile 2 mounted in a cartridge shell 3. The projectile 2 includes a projectile body 4 with a projectile bottom 5 facing toward the cartridge shell 3, and a front arched cavity 6. A propellant chamber 7 in which a propellant charge 8 is mounted is positioned within the cartridge shell 3. The propellant charge ignites upon ignition of an igniter cap, for example. The propulsive gases of the propellant charge flow into the propellant chamber 7 and act upon the projectile bottom 5. When a specific gas pressure within the propellant chamber 7 is exceeded, the connection (not shown) between the cartridge shell 3 and projectile 2 is broken, so that the projectile 2 is driven out of the cartridge shell 3.

The training projectile shown is usually fired from a weapon with a rifled barrel. A twist or guide band 11 is provided on the projectile body 4 to create the spin.

Such training ammunition consisting of a cartridge shell and training projectile is described, for example, in the U.S. Pat. No. 5,936,189.

Reference is made, however, to the fact that the invention is not limited to such training ammunition, but rather may relate to any training projectile with which the strike point of the projectile on the target is to be marked.

The arched cavity 6 is, for example, a plastic part whose shape is cylindrical in its lower area but transforms into an arched cap, for example in the form of a spherical shell. The arched cavity rests, for example, on the projectile body 4 that includes an insert 12 perpendicular to the longitudinal axis of the projectile body 4 that forms the bottom of a hollow cavity defined by the arched cavity 6. A first marking material, for example a dye powder 13, is inserted into this hollow cavity.

A container 21 rests on the insert 12 forming the bottom of the arched cavity 6. The insert is embedded in the dye powder 13, and it accepts two inner containers 22 in the form of ampoules, each of which contains a chemically-active material that, when mixed with the other material, reacts with chemo-luminescence. As soon as the projectile 2 strikes a target, the arched cavity 6 bursts, so that the dye powder 13 is released. Simultaneously, the containers 21 and 22 are broken so that the chemical components within the containers 22 react to create a light effect. This light effect may lie within the visible or the infrared range, and is visible for a long distance. The energy arising during the chemo-luminescent reaction also provides for a more favorable distribution of the dye powder around the strike point.

As mentioned above, it is also possible to fill the inner container with a pyrotechnic charge or other explosive material that reacts from the impact energy alone and thereby produces a flash of light in the visible or infrared range. An impact igniter may also be provided to activate this pyrotechnic material that may be positioned approximately on the front tip of the projectile at the position marked with the index 23.

There has thus been shown and described a novel projectile with means for marking its strike point which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. A training projectile comprising a hollow arched cap at its head that defines a hollow cavity within the head of the projectile and that bursts upon impact of the projectile on a target, the improvement wherein a chemically inactive dye powder and a chemically active chemo-luminescent material are mounted within the cavity, and wherein the chemo-luminescent material includes at least two components mounted in a container which is embedded in the dye powder; wherein the components of the chemo-luminescent material are contained in individual ampoules that are mounted in the container; and wherein the container rests on an insert in the projectile which forms the bottom of the cavity;

whereby upon bursting of the arched cap, the dye powder and the components of the chemo-luminescent material are released, such that the dye powder creates a color effect and, by interacting with one another, the components of the chemo-luminescent material create a light effect.

* * * * *